United States Patent [19]

Fishel

[11] 4,238,262

[45] Dec. 9, 1980

[54] APPLYING PARTICLES AND ADHESIVE TO RACQUET STRINGS

[76] Inventor: Clark W. Fishel, 201 S. Greenville, Allen, Tex. 75002

[21] Appl. No.: 928,239

[22] Filed: Jul. 26, 1978

[51] Int. Cl.[3] ..... A63B 51/02

[52] U.S. Cl. ..... 156/166; 156/279; 156/296; 273/73 D; 427/202; 427/204

[58] Field of Search ..... 273/73 R, 73 C, 73 D, 273/73 G, 73 H, 73 J, 73 K, 75, 76, 167 J; 156/278, 276, 279, 166, 296; 428/372, 195, 400; 427/203, 204, 202, 98, 197

[56] References Cited

U.S. PATENT DOCUMENTS

| | | | |
|---|---|---|---|
| 703,519 | 7/1902 | Becker | 273/167 J |
| 1,682,199 | 8/1928 | Smilie | 273/73 D |
| 2,793,136 | 5/1957 | Root | 273/167 J X |
| 3,834,699 | 9/1974 | Pass | 273/73 D |
| 3,920,658 | 11/1975 | Benson | 273/73 R |
| 3,926,431 | 12/1975 | DeLorean | 273/73 D |

FOREIGN PATENT DOCUMENTS

| | | | |
|---|---|---|---|
| 1062796 | 3/1967 | United Kingdom | 283/167 J |

*Primary Examiner*—Michael W. Ball

*Attorney, Agent, or Firm*—Gerald C. Crutsinger; John F. Booth; Harry C. Post, III

[57] ABSTRACT

Method and apparatus for conditioning the surface of the strings of a racquet such as used in tennis and other racquet sports. The method comprises a first step of applying a first primer coat of adhesive to the strings in the central portion of the racquet by spraying it through a template. The first coat of adhesive is applied to both sides of the strings and after drying a second coat is applied thereto. A granular substance, such as white quartz fractured to the size of 1/50th of an inch having a general cubical-shape, is sprinkled over the second coat of adhesive while damp. After the abrasive settles in and dries, a final sealing layer of adhesive is sprayed over the quartz crystals and second coat. This process both coats and locks the strings together at the intersections to lengthen strike-life and also forms a rough frictional surface on the strings to provide better ball control and create a better spin on the ball when hit.

3 Claims, 4 Drawing Figures

APPLYING PARTICLES AND ADHESIVE TO RACQUET STRINGS

BACKGROUND OF THE INVENTION

Racquets used in ball sports such as tennis, racquet-ball, badminton, and squash generally comprise a head having an oval frame formed on a handle of varying lengths and having strings which extend in perpendicular directions across the head.

The strings are generally strung with a tension in a range between 10 to 70 pounds, depending upon the style of play and preference of the player. The surface of the strings are smooth and slick as manufactured and are generally composed of nylon or animal gut. Over a period of time the smooth strings wear, especially across each other at the intersections of the strings where they are interwoven, creating wear in that location which generally results in the strings breaking.

The accuracy and velocity of the hit ball are two important factors in the play. These factors are often affected by the surface and condition of the strings. Further, another factor in the play is the spin created on the ball when it is hit properly in order to create an altered flight and bounce which is generally harder for the opponent to return. The spin affects the flight and bounce of the ball due to the resistance of the air and the surface of the court such that creating spin results in an advantage over the opponent. The strings must brush over the fuzzy, rough surface of the ball at the moment of hit in order to create the spin, which is relatively difficult since very little friction is developed between the smooth strings of the normal racquet and the surface of the ball.

Heretofore, attempts to increase the roughness of the strings through coating have generally employed an elastomeric material such as natural or synthetic rubber, polyvinyl chloride, alkyd, acrylic, or the like, which may be premixed with a granular substance such as described in the patent to Benson U.S. Pat. No. 3,920,658. Problems have occured in maintaining adhesion in play between the added material and the string of the racquet. Also the abrasive material tends to settle out of the adhesive material when premixed and the added weight of the heavy mixture upsets the delicate balance of the racquet.

Other attempts to prevent wear at the intersections of the strings on a racquet are described in U.S. Pat. No. 3,921,979 which utilizes a self-lubricating plastic cross piece guide which must be placed between each of the racquet strings. This type of construction, although helping prevent wear between the strings, has a tendency to add weight and interfere with the play on the ball.

SUMMARY OF THE INVENTION

I have devised a method and apparatus for increasing the frictional potential of only the central portion of a racquet used to play games such as tennis, racquet-ball, badminton, and squash.

The typical racquet generally comprises an oval head formed of solid metal or laminated wood, fiberglas, or graphite having a handle extending outwardly from one end parallel to the axis through the longest portion of the oval. The typical racquet is strung with string formed of animal gut or nylon or other types of synthetic materials forming a criss-cross pattern at right angles to each other within the rim of the head on the racquet. The strings are interwoven alternately, being positioned on opposite sides of the intersecting string, to form an interwoven type mesh of strings.

In hitting the ball with the head of the racquet, the player attempts to align the racquet so that the ball will hit the central portion of the racquet, thus giving him the most control over the ball. If the ball hits toward the outer periphery of the racquet head, the ball tends to cause the racquet to turn, thus creating an inaccurate shot which will fly at random or may go afoul.

My method of increasing the friction of the central portion of the racquet may be applied to existing or newly manufactured racquets by placing a template over the head of the racquet such that only the central portion of the strings are exposed. A film of adhesive is sprayed onto both sides of the strings to form a primer coat. A second coat of adhesive is sprayed over the first coat after the first coat has dried. A granular substance, such as white quartz fractionalized to 1/50th of an inch having a general cubical shape producing flat sides with sharp corners, is applied into the still damp second layer of adhesive. After the second and third layers are completely integrated and dried, a final layer of adhesive is sprayed over the previous layers to create a composite four-layer coat. After drying and curing for a period of time, the racquet is then ready for use in a conventional manner.

A primary object of the invention is to increase the abrasiveness of the strings of a racquet to create a better frictional contact between the strings of the racquet and the ball when it is hit.

A further object of the invention is to provide a method of coating and securing strings together at the intersections of the strings on the racquet to prevent movement relative to each other and thus prevent wear on the strings which eventually breaks the strings.

A still further object of the invention is to locate the increased abrasive surface in only the central portion ("sweet spot") of the racquet which is cosmetically appealing and adds less weight than applying to all the stringing.

A still further object of the invention is to provide a durable, long-lasting, abrasive surface which bonds to the strings of the racquet and may be applied to existing racquets by anyone without expensive equipment or factory application.

Other and further objects will become more apparent upon referring to the detailed description hereinafter following and to the drawings annexed hereto.

BRIEF DESCRIPTION OF THE DRAWINGS

Drawings of a preferred embodiment of the invention are annexed hereto so that the invention may be better and more fully understood, in which.

Numeral references are employed to designate like parts throughout the various figures of the drawings.

BRIEF DESCRIPTION OF A PREFERRED EMBODIMENT

Figure 1:
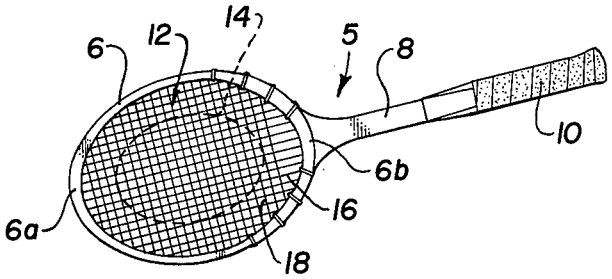
FIG. 1 is a elevational view of a typical tennis racquet with the central portion of the racquet outlined with a dashed line.

Referring to FIG. 1 of the drawings, a typical racquet, generally designated by the numeral 5, is illustrated. Racquet 5 is a typical tennis racquet; however, it is typical of racquets used in racquet ball, squash and badminton except for minor modifications and dimensions such as the handle, size of the head, and weight.

The racquet 5 generally comprises an oval-shaped head 6 generally constructed of solid steel, aluminum, titanium or laminated wood, fiberglas, and graphite; which is oriented such that the long ends 6*a* and 6*b* extend outwardly from the longitudinal axis of handle 8. A cushioned grip 10 is generally wrapped around the end of handle 8. The string area is generally designated 12 and the "sweet spot" or central portion is generally designated by the dashed outline 14. Central portion 14 is the desired location in which the ball should be struck in order to achieve the greatest accuracy and velocity of the ball when playing.

The strings are generally strung in two directions. Strings 16 extend in a first direction parallel to the longitudinal or major axis passing through the long ends 6*a* and 6*b*. Strings 18 extend in a second direction perpendicular to strings 18 which pass from the short sides of the head 6 generally parallel to the minor axis of head 6.

Figure 2:
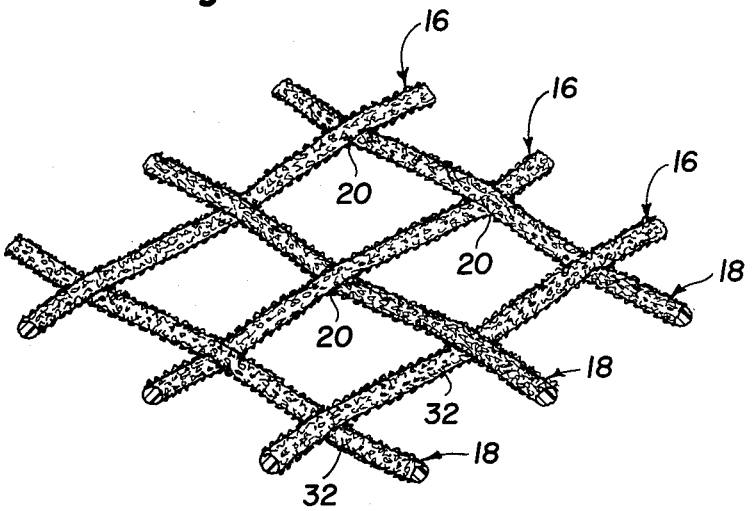
FIG. 2 is an enlarged perspective view of the strings with the adhesive and abrasion surface applied thereto.

As best illustrated in FIG. 2, the strings 16 and 18 are alternately positioned on opposite sides of the strings passing transversely, forming intersections 20. The strings 16 and 18 are tensioned to between 10 and 70 pounds of force, depending upon the desired type of play the user wishes to achieve.

Figure 3:
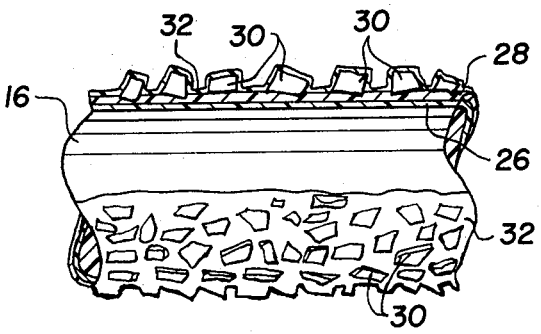
FIG. 3 is an enlarged elevational view of a single string having parts broken away to more clearly illustrate the details of construction.
Figure 4:
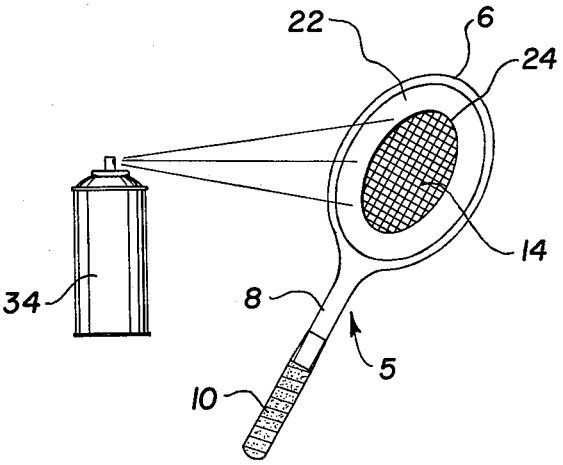
FIG. 4 is a diagrammatic perspective view of the method of applying adhesive to a central portion of a racquet through a template.

In order to increase the friction on the surface of the strings 16 and 18, an abrasive surface must be formed as hereinafter described. A template 22, generally comprising a piece of heavy paper or thin cardboard, is placed within the rim of the head 6 of the racquet 5 as illustrated in FIG. 4 to expose only the central portion 14 of the racquet. The template 22 has an oval-shaped opening 24 corresponding to the sweet spot 14 illustrated in FIG. 1. The adhesive generally comprises a primer layer 26 of adhesive formed by spraying a coat of adhesive over surfaces of strings 16 and 18. After the primer layer 26, as illustrated in FIG. 3, has dried, a bonding layer 28 of adhesive is sprayed over the primer layer 26. The adhesive must be resilient after curing to achieve adequate durability and may be of a type such as a modified epoxy ester resin and titanium dioxide mixture or polyurethane.

A primer layer 26 is preferred such that the adhesive flows between and around the intersection of strings 16 and 18. The primer layer 26 allows more complete curing of the adhesive before applying the bonding layer 28 to prevent the abrasive material from getting between the strings.

It should be readily apparent that the adhesive material used should have sufficient elasticity when cured to permit flexure of the strings.

To form an abrasive surface, a granular substance, such as fine white quartz crystals 30 which have been fractionalized to 1/50th of an inch having a general cubical shape producing flat sides for better adhesion and sharp corners for better friction, is distributed, preferably by sprinkling, over the still damp surface of layer 28. After the bonding layer 28 has cured and the quartz crystals 30 are set in the bonding layer 28, a final sealing layer 32 is sprayed over the bonding layer 28 and crystals 30 such that the crystals 30 are encapsulated between the layers of adhesive. It should be appreciated that the granular substance may also be applied by spraying particles entrained in a lower pressure air stream, dipping, rolling, or brushing on the particles.

The adhesive is preferably stored and dispensed from spray cans 34 illustrated in FIG. 4.

It should be readily apparent that the increased abrasive surface in the central portion 14 of the racquet 5 would produce a better frictional surface for contact with the ball or bird having soft and rough surface.

The increased friction of the area 14 will produce a greater abrasion between the surface of the strings 16 and 18 of racquet 5 and the surface of the ball when hit to allow the angular movement of the racquet to produce a spin on the ball to provide an advantage over the opponent. This also provides greater control and better placement of the ball on the court where the game is played.

It should be readily apparent that the invention hereinbefore described accomplishes each of the objects hereinbefore discussed.

It should be readily apparent that other and further embodiments of the invention may be devised without departing from the basic concept of the invention described herein.

Having described my invention, I claim:

1. A method of forming an abrasive surface on the central portion of a racquet, comprising the steps of: masking the head of the racquet with only the central portion of the strings being exposed; applying a primer coat of adhesive material onto the exposed portion of the strings; partially curing the primer layer to bond the strings together at the intersections; applying a second layer of adhesive material over the partially cured primer layer to form a bonding layer; depositing a granular substance over the bonding layer of adhesive material; curing the bonding layer to bond the granular substance to the strings; applying a sealing layer of adhesive over the bonding layer and granular material; and curing the sealing layer to encapsulate the granular material between the primer and sealing layers.

2. A method of forming an abrasive surface on the central portion of a racquet according to claim 1, including the step of choosing the granular substance to be white quartz crystals having a maximum dimension of less than 1/50th of an inch and having a generally cubicle shape with flat sides and sharp corners.

3. A method of forming an abrasive surface on the central portion of a racquet according to claim 2, the step of applying a bonding layer of adhesive onto each side of the exposed portion of the strings includes spraying the adhesive over the bonding layer and granular material.

* * * * *